US005477720A

United States Patent [19]

Lentz et al.

[11] Patent Number: 5,477,720

[45] Date of Patent: Dec. 26, 1995

[54] DEVICE FOR ROLLER-FLANGING CYLINDRICAL BODIES

[75] Inventors: Norbert Lentz, Essen; Dieter Muno, Mülheim; Harald Schmidt, Langerwehe, all of Germany

[73] Assignee: Krupp Maschinentechnik Gesellschaft mit beschränkter Haftung, Essen, Germany

[21] Appl. No.: 238,323

[22] Filed: May 5, 1994

[30] Foreign Application Priority Data

May 7, 1993 [DE] Germany ..... 43 15 214.7

[51] Int. Cl.[6] ..... B21D 19/04

[52] U.S. Cl. ..... 72/124; 72/126

[58] Field of Search ..... 72/118, 119, 124, 72/126

[56] References Cited

U.S. PATENT DOCUMENTS

| | | | |
|---|---|---|---|
| 2,250,799 | 7/1941 | Harrison | 93/36.5 |
| 3,633,469 | 1/1972 | Kinney | 72/126 |
| 4,747,287 | 5/1988 | Azzaline et al. | 72/125 |
| 5,121,621 | 6/1992 | Ihly | 72/126 |
| 5,150,595 | 9/1992 | Ihly | 72/124 |
| 5,235,839 | 8/1993 | Lee, Jr. et al. | 72/126 |

FOREIGN PATENT DOCUMENTS

| | | | |
|---|---|---|---|
| 748912 | 7/1933 | France | B21D 19/12 |
| 416539 | 7/1925 | Germany | B21D 19/12 |
| 2257210 | 5/1974 | Germany | B21D 51/26 |
| 7621025 | 11/1976 | Germany | B21D 19/12 |
| 1-95823 | 4/1989 | Japan . | |

*Primary Examiner*—Lowell A. Larson
*Attorney, Agent, or Firm*—Spencer, Frank & Schneider

[57] ABSTRACT

An roller-flanging device for flanging at least an end region of a cylindrical body includes a receptacle having a longitudinal axis common with the cylindrical body being flanged. Flange rollers are rotatably seated in the receptacle about the common longitudinal axis, and roll along a surface of the cylindrical body. The flange rollers each have a part with a cylindrical surface and a flange collar for forming a flange contour on the cylindrical body. At least one limiting body is disposed between contiguous ones of the flange rollers, and extends inwardly toward the common longitudinal axis beyond the circumscribed cylindrical surface of the cylindrical parts of the flange rollers at least when forming the flange. The at least one limiting body prevents burrs or material from the cylindrical body from reaching or extending beyond the cylindrical surface of the flange rollers, and assures a uniform flange diameter.

19 Claims, 3 Drawing Sheets

14
23
24
25
R
11
10"
10'
10
15
16
17
B
18
21
13
22

DEVICE FOR ROLLER-FLANGING CYLINDRICAL BODIES

CROSS REFERENCE TO RELATED APPLICATION

This application claims the priority of German Application No. P 43 15 214.7 filed May 7, 1993, which is incorporated herein by reference.

BACKGROUND OF THE INVENTION

1. Field of the Invention

The invention relates to roller-flanging (also known as spin flanging) cylindrical bodies, at least in one edge region, with a device having a plurality of flange rollers that are rotatably seated in a receptacle and roll along the cylindrical body to be reshaped, forming a flange with their contour.

2. Background Information

Flanging is the bending of an edge of a sheet metal piece, e.g., for work piece reinforcement, or in order to blunt the edge. In can bodies to be flanged, for example, flanging is a preparatory process in which the cylinder jacket of the can body is reshaped over its entire circumference in the region of its edges. The shaped flange is particularly specified by the flange radius (R) that adjoins the final contour of the can and an end region of the flange which is principally unbent and is, for the most part, oriented perpendicular to the longitudinal cylinder (can) axis.

Flange rollers serve to form the flange in the can body. These flange rollers rotate and are disposed in a common receptacle on a circle whose diameter is selected based on the diameter of the can to be flanged.

The receptacle rotates relative to the can body about an axis of rotation corresponding to the longitudinal axis of the can body. A limiting ring encompasses the flange rollers with its inner jacket and is seated coaxially to the longitudinal axis of the can body.

The inner diameter of the limiting ring serves to define the maximum flange diameter or circumference, as follows. The can body, also referred to as a can body blank, is placed above the flange rollers, and the can body and the set of flange rollers are guided closer together. The bottom end of the can will be bent outwardly until it has a diameter that corresponds to the inner diameter of the limiting ring.

There is a gap into which flanged material or burr of the treated work piece (flanged can) can extend located between the limiting ring and the flange rollers. However, this can result in coatings of the flanging device parts becoming damaged. Moreover, the threat exists of the can body being uncontrollably carried along by the flange rollers, with the consequence of deformation and pronounced unevenness of the resulting flange.

SUMMARY OF THE INVENTION

It is therefore an object of the present invention to overcome these drawbacks and improve on the prior device in such a way that damage due to penetration of burrs, or of the can body or can body blank, is prevented. It is a further object to ensure that the flange diameter is produced uniformly over the can circumference.

An apparatus according to one embodiment of the invention for roller-flanging at least an end region of a cylindrical body includes a receptacle having a longitudinal axis common with the cylindrical body being flanged, a plurality of flange rollers, rotatably seated in the receptacle about the common longitudinal axis, which roll along a surface of the cylindrical body, the flange rollers each having a part with a cylindrical surface and a flange collar for forming a flange contour on the cylindrical body, and at least one limiting body, disposed between contiguous ones of the plurality of flange rollers, the at least one limiting body extending inwardly toward the common longitudinal axis beyond the circumscribed cylindrical surface of the cylindrical part of the flange rollers at least when forming the flange. An advantage of this embodiment is that the at least one limiting body prevents burrs or material from the cylindrical body from reaching or extending beyond the cylindrical surface of the flange rollers, and assures a uniform flange diameter.

According to one embodiment, the at least one limiting body is stationary. In another embodiment, the at least one limiting body rotates. Advantageously, the at least one limiting body may be cylindrical.

In another embodiment, at least one limiting body may be provided between all contiguous ones of the plurality of flange rollers.

According to another aspect of the invention, the at least one limiting body may be one, or a plurality of rotatably seated rollers, longitudinal axes of the limiting body rotatably seated rollers being disposed on a circle about the common axis of the device. The limiting body rotatably seated rollers may be displaceable radially from the common longitudinal axis by guide pieces or an eccentric seating arrangement, for example. The flange rollers may also be displaceable radially from the common longitudinal axis by guide pieces or an eccentric seating arrangement.

According to another aspect of the invention, the limiting body rotatably seated rollers are driveable so that a relative velocity between a working surface of the limiting body rotatably seated rollers and an edge of the flange formed on the cylindrical body is zero, thereby preventing damage to the can body or the rollers.

According to another aspect of the invention, the limiting body rotatably seated rollers may be disposed so that their working surfaces are at right angles to an edge of the flange formed on the cylindrical body. In a further aspect of the invention, the flange rollers and the limiting body rotatably seated rollers are seated in the receptacle, and the receptacle rotates around the common longitudinal axis.

According to another advantageous aspect of the invention, the at least one limiting body is formed such that it effects a reshaping of the flange contour formed by the flange rollers.

An advantageous method of forming a flange in a cylindrical body is therefore achieved by utilizing an embodiment of the apparatus according to the invention.

Therefore, these and other advantages and features are accomplished by a device in accordance with the invention for flanging a cylindrical body, characterized by one or a plurality of limiting bodies that is/are disposed between contiguous flange rollers at least when the maximum flange diameter is reached, and protrude(s) inwardly beyond the circumscribed cylindrical surfaces of the flange rollers around the longitudinal axis with its/their jacket surface which faces the common longitudinal axis of the device and the cylindrical body.

An advantageous aspect of the present invention is therefore the provision of a jacket-side limitation of the flange that does not correspond to the limiting ring used up until now.

The limiting body of the invention can be configured in one piece as a sleeve body having recesses or windows for the parts of the flange rollers that form the flange geometry. The inner jacket surface of the limiting body can, however, also have a wavy shape parallel to the common longitudinal axis in order to extend with parts between contiguous flange rollers. The surface of the limiting body in this instance is embodied such that the flange extending there is guided with little friction.

Alternatively, individual limiting bodies may be provided whose smallest common inner jacket diameter projects inwardly beyond the cylindrical circumscribed curve determined by the parts of the flange rollers that form the flange geometry. This prevents the outer edge of the flange from protruding beyond the flange rollers, thus preventing uncontrolled flange movements. Also, the limiting bodies may be provided to contact the flange at the point in time at which flange bending occurs. Because of this it is possible in principle to move relevant limiting bodies toward each other at this time in clock-actuated fashion and in a star formation in order to limit the maximum flange diameter all the way around.

As already mentioned, the limiting body can be configured to be stationary or rotatable. The embodiment of rotatable bodies, particularly individual limiting bodies, has the advantage that carrying movements of the limiting bodies which minimize the friction between the flange and the limiting bodies are controllable. The limiting bodies are preferably cylindrical so that they essentially guide the flange tangentially in a limiting manner.

In accordance with the invention, at least one limiting body may be positioned "on the gap", that is provided between each pair of contiguous flange rollers. If one (or each) limiting body is configured as a rotatably seated roller that may be equipped with its own drive, the advantage of less rolling friction can be utilized. Particularly for motor-driven rollers, and with respect to the structural arrangement, it is advisable to position the axes of the limiting rollers on a circle or a cylinder jacket.

Slippage between the flange and limiting rollers while a cylindrical body is transported into the device can be eliminated when the limiting rollers have their own drives and a direction of movement opposite to that of the flange rollers, as well as a velocity that corresponds to that of the outermost edge of the flange, in the phase of mutual contact. Advantageously, a gentle reshaping of even very thin and sensitive materials can be realized.

Positioning the working surfaces of the limiting bodies, preferably limiting rollers, at a right angle to the edge of the flange can prevent any change in the height of the flange between the flange rollers, as well as a consequent unevenness in the flange form. The flange rollers and limiting rollers are preferably seated in a common receptacle that can rotate around a central axis that coincides with the can axis.

To be able to influence the flange width, the limiting rollers are seated, preferably in guide pieces or by means of an eccentric seating, to be displaced radially, in the direction of a change in the distance of their axes of rotation from the central longitudinal axis or axis of rotation of the receptacle. This also enables flanging cylindrical bodies of different diameters.

Finally, the working surfaces of the limiting rollers are preferably formed in such a way that they can effect an additional reshaping of the flange, in addition to limiting the flange dimensions. Both the flange rollers and the limiting bodies then serve to shape the flange.

BRIEF DESCRIPTION OF THE DRAWINGS

The above and other features and advantageous embodiments of the invention will become apparent from the following detailed description taken with the drawings in which.

DETAILED DESCRIPTION OF THE PREFERRED EMBODIMENTS

The invention will now be described in more detail by example with reference to the embodiments shown in the Figures. It should be kept in mind that the following described embodiments are only presented by way of example and should not be construed as limiting the inventive concept to any particular physical configuration.

Figure 1:
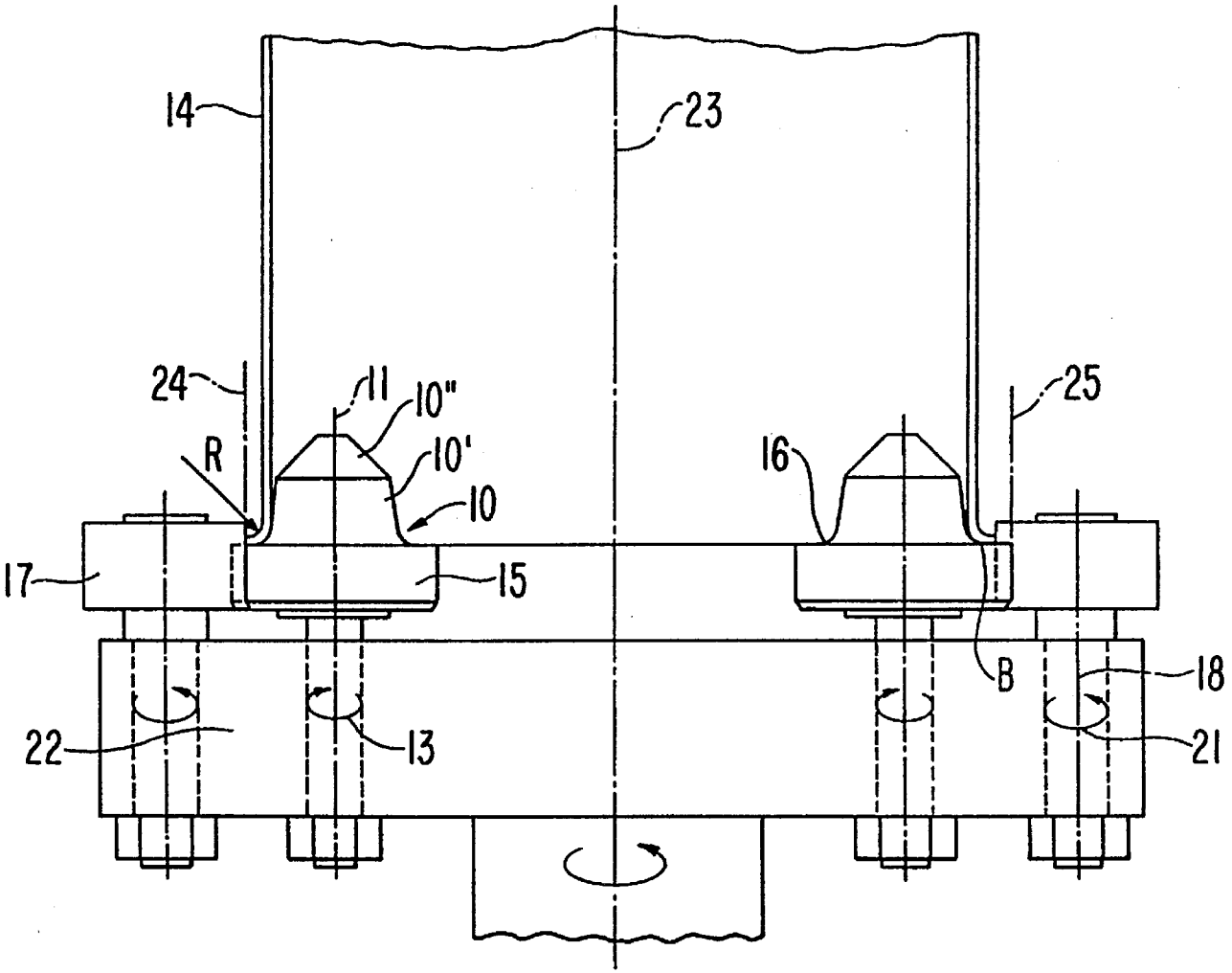
FIG. 1 shows a flanging device for the lower edge of a can body in a vertical section along line I—I of FIG. 2.
Figure 2:
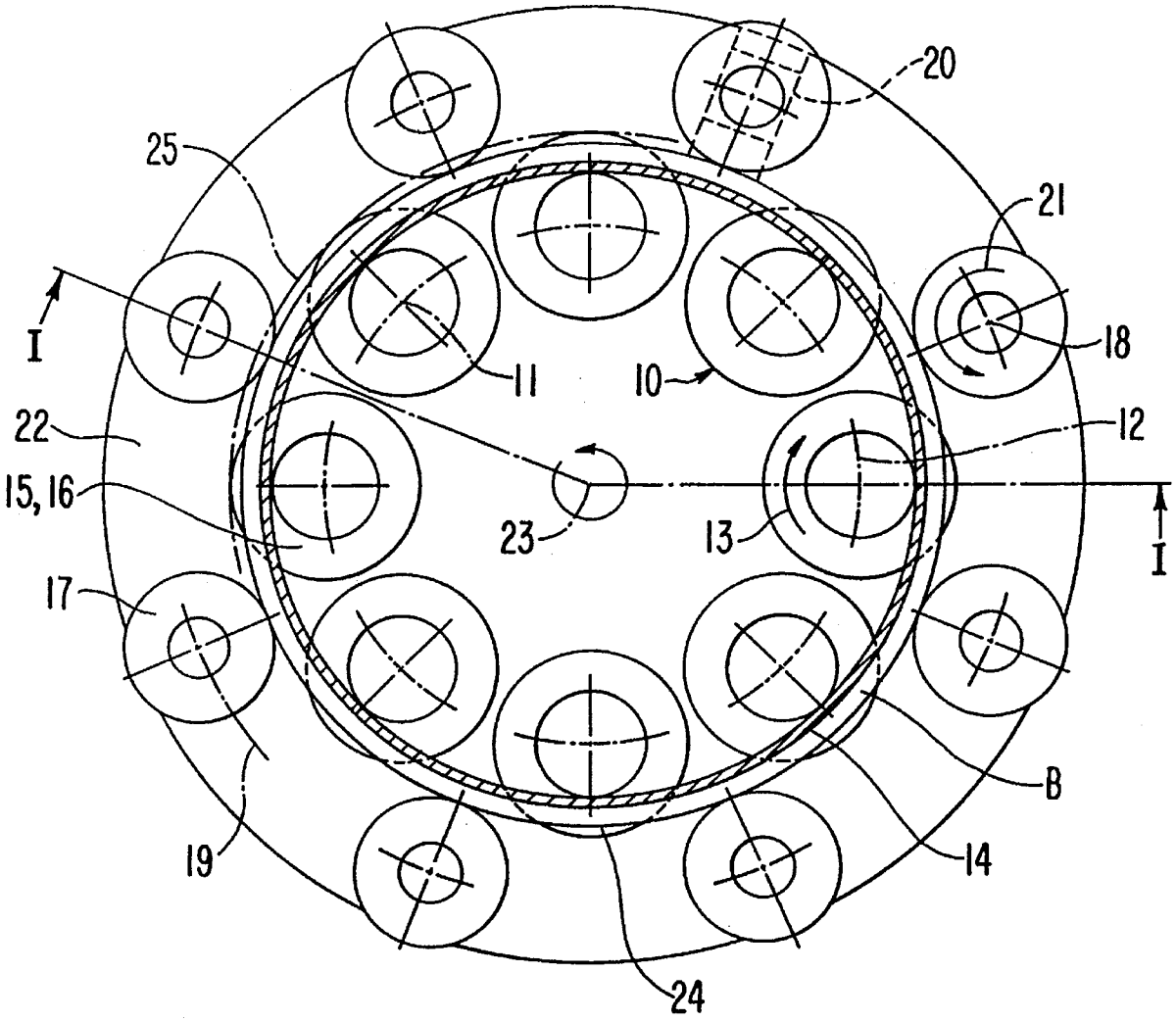
FIG. 2 shows the flanging device in a top view partially in section.

An exemplary embodiment of a device according to the invention for roller-flanging cylindrical bodies, as illustrated in FIGS. 1 and 2, includes a plurality—in this case eight—flange rollers 10, whose longitudinal axes or axes of rotation 11 are disposed on a common circle or pitch circle 12 about the central axis 23 of the device. Flange rollers 10 respectively execute a rotational movement (see arrow 13) and roll along the circular edge of a cylinder or can body 14, thereby forming a flange B.

For flanging, can body 14 is guided, for example by being lowered, toward rollers 10. Flange rollers 10 have a lower, cylindrical part 15 of relatively large diameter, and a shoulder or collar 16, by means of which the flange B is formed on the can body 14. Flange rollers 10 are conical at an end facing the can body, including a first part 10', with a small conical angle, and then a tip 10", with a large conical angle, above cylindrical part 15.

In accordance with the invention, limiting rollers 17, whose longitudinal axes or axes of rotation 18 are disposed on a common circle or pitch circle 19, are provided in gaps between flange rollers 10. Limiting rollers 17 may be radially displaceable, which can be effected in translatory fashion by means of guide pieces 20 or an eccentric seating. Limiting rollers 17 are guided, at least at the time of contact with flange B to be produced, such that they lie between the flange rollers 10 on a respective median.

Flange rollers 10 and limiting rollers 17 are seated in a common receptacle 22 that rotates around the central longitudinal axis 23 which coincides with the can axis. The maximum diameter resulting from the flanging process can be set by positioning limiting rollers 17, that is, setting the radius of circle 19, on which the axes of rotation 18 of the rollers are located.

For a given, fixed arrangement of flange rollers 10 in receptacle 22, the geometrical configuration of flange B can be changed, i.e., the flange width can be influenced. The diameter of the circle (imaginary) or inscribed cylindrical surface 24 defined by the inward extent of surfaces of limiting rollers 17 corresponds to an outer diameter of the completed flanged edge B, and is always smaller than the diameter of a circle or circumscribed cylindrical surface 25 defined by the outward extent of the lower parts 15 (cylindrical surfaces) of flange rollers 10.

To prevent damage to can body 14, limiting rollers 17 may be likewise driven (see FIG. 2, arrow 21) so that no relative velocity arises between the can body 14 and flange rollers 10 on one side (inner side), and between the can body 14 and limiting rollers 17 on the other side (outer side). The directions of rotation of flange rollers 10 and limiting rollers 17, as illustrated by the directional arrows 13 and 21, respectively, are opposite one another.

The drawing figures illustrate a flanging device in an orientation for flanging a lower edge of a can body. As would be readily apparent to one skilled in the art, a device for simultaneous flanging both upper and lower edges of a can body would include a device as described and illustrated in FIGS. 1 and 2 in duplicate, with one above the other, facing each other. The upper device would therefore be inverted and face in the opposite direction as the lower device illustrated in FIG. 1. The flange rollers (10) of the upper device would be located under a receptacle (22), with the roller part (15) that has the larger diameter being on top and the conical tip (10") being downwardly-oriented.

In such an arrangement of upper and lower devices, the directions of rotation of identical parts of the upper and lower flanging device, with respect to the direction of central longitudinal axis 23, would be opposite, so that can body 14 does not rotate during flanging when all forces are applied, even and though can body is not fixed.

In another modification, in order to be able to achieve use of the flanging device for other can diameters (circumferences), the flange rollers 10 may also be disposed in receptacle 22 in the way described for limiting rollers 17, that is, to be displaceable and adjustable in the radial direction of a change in the diameter of circle 12.

Figure 3:
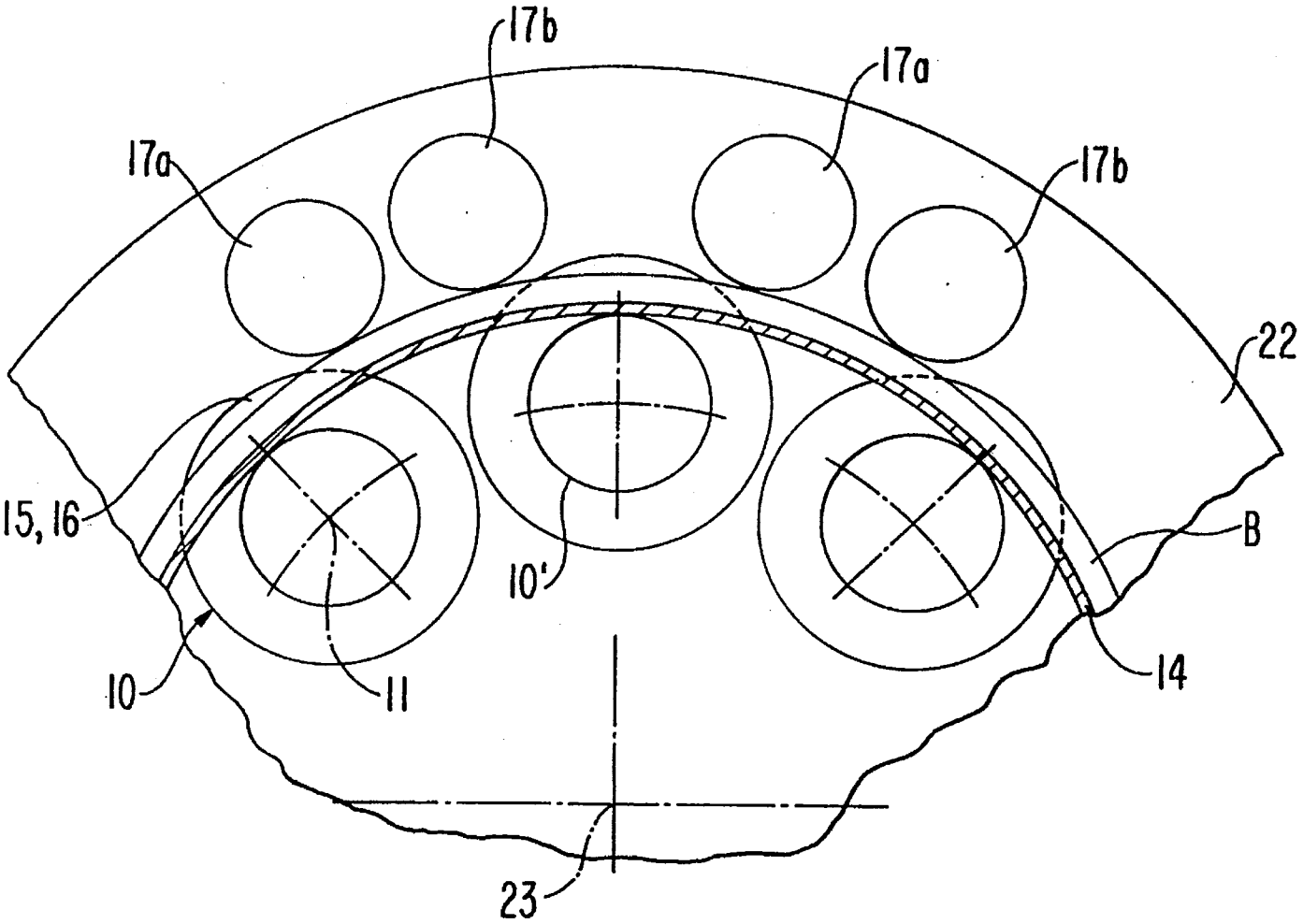
FIG. 3 shows a modified embodiment of the flanging device in a fragmentary top view.

In a further modification of the exemplary described embodiment according to FIGS. 1 and 2, two limiting rollers 17*a*, 17*b* of a smaller diameter are disposed between respectively two flange rollers 10 in the flanging device, as indicated in FIG. 3. One skilled in the art would readily recognize that the number of limiting rollers per flange roller is not necessarily limited to two as illustrated, but may comprise as many as is practical and desirable to achieve the uniformity of flange diameter wanted. Likewise, the number of flanging rollers is not limited to the eight shown in the illustrated embodiments.

It will be understood that the above description of the preferred embodiment of the present invention is susceptible to various modifications, changes, and adaptations, besides those already described, and the same are intended to be comprehended within the meaning and range of equivalents of the appended claims.

What is claimed is:

1. An apparatus for roller-flanging at least one end region of a cylindrical body, the apparatus comprising:

a receptacle having a longitudinal axis common with the cylindrical body being flanged;

a plurality of flange rollers, rotatably seated in the receptacle about the common longitudinal axis, which roll along a surface of the cylindrical body, the flange rollers each having a part with a cylindrical surface and a flange collar for forming a flange contour on the cylindrical body; and at least one limiting body, disposed between contiguous ones of the plurality of flange rollers, the at least one limiting body extending inwardly toward the common longitudinal axis beyond the circumscribed cylindrical surface of the cylindrical parts of the flange rollers at least when forming the flange;

whereby the at least one limiting body prevents burrs or material from the cylindrical body reaching or from extending beyond the cylindrical surface of the flange rollers, and assures a uniform flange diameter.

2. An apparatus as defined in claim 1, wherein the at least one limiting body rotates.

3. An apparatus as defined in claim 1, wherein the at least one limiting body is cylindrical.

4. An apparatus as defined in claim 1, wherein at least one limiting body is provided between all contiguous ones of the plurality of flange rollers.

5. An apparatus as defined in claim 1, wherein each limiting body is a rotatably seated roller.

6. An apparatus as defined in claim 5, wherein longitudinal axes of the limiting body rotatably seated rollers lie on a circle about the common longitudinal axis.

7. An apparatus as defined in claim 5, wherein the limiting body rotatably seated rollers are displaceable radially from the common longitudinal axis.

8. An apparatus as defined in claim 7, wherein the limiting body rotatably seated rollers are displaceable radially from the common longitudinal axis by one of:

guide pieces, and an eccentric seating arrangement.

9. An apparatus as defined in claim 5, wherein the limiting body rotatably seated rollers are driveable.

10. An apparatus as defined in claim 5, wherein the limiting body rotatably seated rollers are driven so that a relative velocity between a working surface of the limiting body rotatably seated rollers and an edge of the flange formed on the cylindrical body is zero, whereby damage to the cylindrical body and/or the rollers is prevented.

11. An apparatus as defined in claim 10, wherein the limiting body rotatably seated rollers are disposed so that working surfaces thereof are at right angles to an edge of the flange formed on the cylindrical body.

12. An apparatus as defined in claim 5, wherein the flange rollers and the limiting body rotatably seated rollers are seated in the receptacle, and wherein the receptacle rotates around the common longitudinal axis.

13. An apparatus as defined in claim 5, wherein the limiting body rotatably seated rollers and the flange rollers are each independently displaceable radially from the common longitudinal axis by respective ones of:

guide pieces, or eccentric seating arrangements.

14. An apparatus as defined in claim 1, wherein the flange rollers are displaceable radially from the common longitudinal axis.

15. An apparatus as defined in claim 14, wherein the flange rollers are displaceable radially from the common longitudinal axis by one of:

guide pieces, or an eccentric seating arrangement.

16. An apparatus as defined in claim 1, wherein the at least one limiting body effects a reshaping of the flange contour initially formed by the flange rollers.

17. A method of forming a flange in a cylindrical body which comprises utilizing the apparatus of claim 1.

18. A flange forming device comprising:

receiving means for receiving a cylindrical body;

flange roller means, rotatably disposed on said receiving means, for forming a flange on the cylindrical body; and limiting means, disposed on said receiving means, extending inwardly toward a common longitudinal axis of the device and the cylindrical body beyond a circumscribed cylindrical surface of the flange roller means, for limiting the extent of the flange on the cylindrical body in a radial direction and assuring a uniform flange diameter.

19. An apparatus for roller-flanging first and second end regions of a cylindrical body, the apparatus comprising:

first and second respective receptacles, each having a longitudinal axis, the longitudinal axes being common with the cylindrical body being flanged;

a respective first and second plurality of flange rollers, rotatably seated in the first and second receptacles, respectively, about the common longitudinal axis, which roll along a respective end region surface of the cylindrical body, the flange rollers each having a cylindrical surface and a flange collar for forming a flange contour on the cylindrical body; and at least two respective first and second limiting bodies, each respective limiting body being disposed between respective contiguous ones of the plurality of flange rollers, each respective limiting body extending inwardly toward the common longitudinal axis beyond the circumscribed cylindrical surface of the respective flange rollers at least when forming the flange;

whereby the respective limiting bodies prevent burrs or material from a respective end region of the cylindrical body from reaching or extending beyond the cylindrical surface of the respective flange rollers, and assure a uniform flange diameter at both respective ends of the cylindrical body.

* * * * *